US012098506B1

(12) United States Patent
Awada et al.

(10) Patent No.: US 12,098,506 B1
(45) Date of Patent: Sep. 24, 2024

(54) METHOD OF FORMING GLASS-LIKE SHEETS USING DATE PALM SEEDS

(71) Applicant: KING FAISAL UNIVERSITY, Al-Ahsa (SA)

(72) Inventors: Chawki Awada, Al-Ahsa (SA); Mohd Al Saleh Al Othoum, Al-Ahsa (SA); Mohammed Ibrahim Albossed, Al-Ahsa (SA)

(73) Assignee: KING FAISAL UNIVERSITY, Al-Ahsa (SA)

( * ) Notice: Subject to any disclaimer, the term of this patent is extended or adjusted under 35 U.S.C. 154(b) by 0 days.

(21) Appl. No.: 18/442,895

(22) Filed: Feb. 15, 2024

(51) Int. Cl.

| | |
|---|---|
| ***D21C 3/02*** | (2006.01) |
| ***D21C 9/16*** | (2006.01) |
| ***D21H 11/12*** | (2006.01) |
| ***D21H 27/06*** | (2006.01) |

(52) U.S. Cl.
CPC ..... *D21C 3/022* (2013.01); *D21C 9/163* (2013.01); *D21H 5/0077* (2013.01); *D21H 11/12* (2013.01)

(58) Field of Classification Search
CPC ..... D21C 3/022; D21C 9/163; D21H 5/0077
See application file for complete search history.

(56) References Cited

U.S. PATENT DOCUMENTS

2015/0137023 A1* 5/2015 Abu-Jdayil ..... E04B 1/76 252/62
2016/0186664 A1* 6/2016 Kirtley ..... F02C 7/28 415/115
2017/0137688 A1* 5/2017 Amanullah ..... C09K 8/516
2018/0186664 A1* 7/2018 Alkendi ..... C08L 1/02
2020/0023546 A1 1/2020 Li et al.
2020/0095728 A1* 3/2020 Hindi ..... D21C 9/163

FOREIGN PATENT DOCUMENTS

IN 202211018890 A 4/2022
WO 2020139825 A1 12/2010

OTHER PUBLICATIONS

Hassan et al., Evaluation of the hardness and wear behavior of date seed powder/epoxy composites as potential biomaterials, Dec. 2023, Journal of Engineering and Thermal Science. (Year: 2023).*
Elkhouly et al., Eco-friendly date-seed nanofillers for polyethylene terephthalate composite reinforcement,Feb. 2020, Materials Research Express, 7. (Year: 2020).*

(Continued)

*Primary Examiner* — Anthony Calandra
(74) *Attorney, Agent, or Firm* — Nath, Goldberg & Meyer; Joshua B. Goldberg

(57) ABSTRACT

A method of forming glass-like sheets using date palm seeds is provided. The method includes milling date palm seeds to form a powder. The powder is compressed to form discs, after which the discs are immersed in a delignification solution followed by removal from the delignification solution and washing. The discs formed from the date palm seed powder are immersed in a bleaching solution until a change in color is observed from opaque to transparent. The transparent discs thus formed are then hardened through application of an epoxy resin. The initial grinding procedure may be substituted by an initial slicing step of the date palm seeds in a similar method of forming the glass-like sheets.

12 Claims, 1 Drawing Sheet

(56) References Cited

OTHER PUBLICATIONS

Raza et al., solation and Characterization of Cellulose Nanocrystals from Date Palm Waste, 2022, ACS Omega, 7. (Year: 2022).*
"DIY Transparent Wood—Overview, Recipe, and Examples" published at https://www.youtube.com/watch?v=7uH628dpa5k&t=218s on Jul. 9, 2016.
Mi, Ruiyu, et al. "A clear, strong, and thermally insulated transparent wood for energy efficient windows." Advanced Functional Materials 30.1 (2020): 1907511.

* cited by examiner

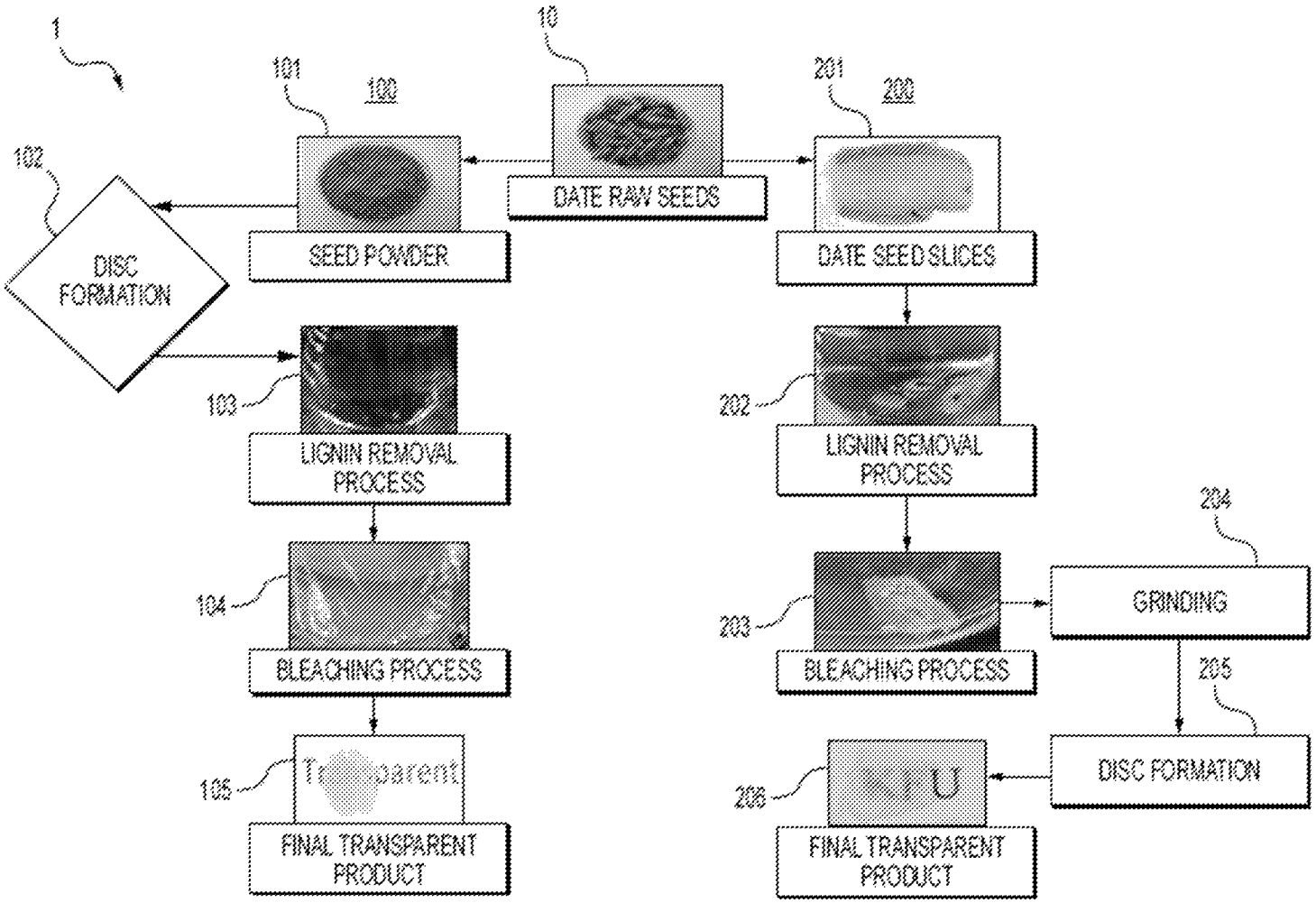
1
10
DATE RAW SEEDS
100
101
SEED POWDER
102
DISC FORMATION
200
201
DATE SEED SLICES
202
LIGNIN REMOVAL PROCESS
203
BLEACHING PROCESS
204
GRINDING
205
DISC FORMATION
206
FINAL TRANSPARENT PRODUCT
103
LIGNIN REMOVAL PROCESS
104
BLEACHING PROCESS
105
FINAL TRANSPARENT PRODUCT

METHOD OF FORMING GLASS-LIKE SHEETS USING DATE PALM SEEDS

BACKGROUND

Field

The disclosure of the present patent application relates to the formation of transparent or translucent glass-like sheets, and particularly to a method of recycling date palms seeds in forming such glass-like sheets.

Description of Related Art

The date palm fruit is composed of a seed and fleshy pericarp (outer ripened walls). Many uses are known for the pericarp portion of the date palm fruit, including direct consumption, as well as the formation of date powders, syrups, chocolate-coated dates, juices, and confectionery. The seed of the date palm fruit is usually discarded as a waste material. However, date palm seeds have potential to be utilized as a resource for a variety of applications. Interest has developed in date palm seeds due to their nutrition properties, low cost, affordability, low environmental impact, and high cellulosic content. One potential application for the recycling of date palm seeds is in the production of transparent glass-like sheets. Traditional glass production may involve energy-intensive processes and produce greenhouse gas emissions. New ways of recycling date palm seeds as a sustainable resource for the production of glass-like sheets are desired, in an energy efficient manner which produces fewer pollutants than processes used in traditional glass production.

SUMMARY OF THE INVENTION

A method of forming glass-like sheets using date palm seeds is disclosed. The method includes milling date palm seeds to form a powder. Next the powder is compressed to form discs, after which the discs are immersed in a delignification solution followed by removal from the delignification solution and washing. The discs formed from the date palm seed powder are then immersed in a bleaching solution until a change in color of the discs is observed from opaque to transparent. The transparent discs thus formed are then hardened through application of an epoxy resin.

In an embodiment, a method of transforming date seeds into transparent sheets is provided. The method includes grinding date seeds in a ball mill to form a powder. Next, discs are formed from the powder using a hydraulic press. The discs are then immersed in a boiling delignification solution made of water, sodium hydroxide and sodium sulfite for at least 12 hours, followed by removal from the delignification solution, and washing. The delignified discs are then immersed in a bleaching solution of hydrogen peroxide until a color of the discs change from opaque to transparent, or translucent. The discs are then hardened through application of an epoxy resin, which includes resin and a non-blushing hardener in a ratio of about 2:1.

In a further embodiment, a method of forming glass-like sheets using date palm seeds is provided, including a first step of cutting date palm seeds to form slices. The slices are then immersed in a delignification solution, followed by removal from the delignification solution and washing. The slices are then placed in a bleaching solution until a change in color is observed from opaque to transparent or translucent. Next, grinding is performed of the now transparent or translucent slices using a ball mill to form a powder. The transparent or translucent powder is then compressed to form discs, which are then hardened by application of an epoxy resin.

These and other features of the present subject matter will become readily apparent upon further review of the following specification.

BRIEF DESCRIPTION OF DRAWINGS

FIG. 1 is a block diagram of a first and second method of forming glass-like sheets using date palm seeds.

Similar reference characters denote corresponding features consistently throughout the attached drawings.

DETAILED DESCRIPTION

Definitions

It should be understood that the drawings described above or below are for illustration purposes only. The drawings are not necessarily to scale, with emphasis generally being placed upon illustrating the principles of the present teachings. The drawings are not intended to limit the scope of the present teachings in any way.

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" include plural references unless the context clearly dictates otherwise.

In the application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a composition or a method described herein can be combined in a variety of ways without departing from the spirit and scope of the present teachings, whether explicit or implicit herein.

The use of the terms "include," "includes", "including," "have," "has," or "having" should be generally understood as open-ended and non-limiting unless specifically stated otherwise.

The use of the singular herein includes the plural (and vice versa) unless specifically stated otherwise. In addition, where the use of the term "about" is before a quantitative value, the present teachings also include the specific quantitative value itself, unless specifically stated otherwise. As used herein, the term "about" refers to a ±10% variation from the nominal value unless otherwise indicated or inferred.

The term "optional" or "optionally" means that the subsequently described event or circumstance may or may not occur, and that the description includes instances where said event or circumstance occurs and instances in which it does not.

Unless defined otherwise, all technical and scientific terms used herein have the same meaning as commonly understood to one of ordinary skill in the art to which the presently described subject matter pertains.

Where a range of values is provided, for example, concentration ranges, percentage ranges, or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

Throughout the application, descriptions of various embodiments use "comprising" language. However, it will be understood by one of skill in the art, that in some specific instances, an embodiment can alternatively be described using the language "consisting essentially of" or "consisting of".

For purposes of better understanding the present teachings and in no way limiting the scope of the teachings, unless otherwise indicated, all numbers expressing quantities, percentages or proportions, and other numerical values used in the specification and claims, are to be understood as being modified in all instances by the term "about". Accordingly, unless indicated to the contrary, the numerical parameters set forth in the following specification and attached claims are approximations that may vary depending upon the desired properties sought to be obtained. At the very least, each numerical parameter should at least be construed in light of the number of reported significant digits and by applying ordinary rounding techniques.

It should be understood that the drawings described above or below are for illustration purposes only. The drawings are not necessarily to scale, with emphasis generally being placed upon illustrating the principles of the present teachings. The drawings are not intended to limit the scope of the present teachings in any way.

Throughout the application, where compositions are described as having, including, or comprising specific components, or where processes are described as having, including, or comprising specific process steps, it is contemplated that compositions of the present teachings can also consist essentially of, or consist of, the recited components, and that the processes of the present teachings can also consist essentially of, or consist of, the recited process steps.

It is noted that, as used in this specification and the appended claims, the singular forms "a", "an", and "the" include plural references unless the context clearly dictates otherwise.

In the application, where an element or component is said to be included in and/or selected from a list of recited elements or components, it should be understood that the element or component can be any one of the recited elements or components, or the element or component can be selected from a group consisting of two or more of the recited elements or components. Further, it should be understood that elements and/or features of a composition or a method described herein can be combined in a variety of ways without departing from the spirit and scope of the present teachings, whether explicit or implicit herein.

FIG. 1 illustrates a method 1 of forming transparent or glass-like sheets using date palm seeds 10. A pair of embodiments 100 and 200 are shown. First embodiment 100 includes block 101 where date palm seeds 10 are milled to form a powder. Next, in block 102 the powder is compressed to form discs, after which the discs are immersed in a delignification solution shown as block 103, followed by removal from the delignification solution and washing. The discs formed from the date palm seed powder are then immersed in a bleaching solution at block 104 until a change in color of the discs is observed from opaque to transparent. The transparent discs thus formed at block 105 are then hardened through application of an epoxy resin.

In a further embodiment 200, a method of forming transparent or glass-like sheets includes a first step of cutting date palm seeds to form slices at block 201. The slices are then immersed in a delignification solution at block 202, followed by removal from the delignification solution and washing. Next at block 203 the slices are placed in a bleaching solution until a change in color is observed from opaque to transparent or translucent. After the bleaching performed at block 203, the slices thus formed may be used as the transparent slices thus formed. However, an additional step of grinding at block 204 may also be performed on the now transparent or translucent slices using a ball mill to form a powder. The transparent or translucent powder is then compressed to form discs at block 205, which are then hardened by application of an epoxy resin to form a final transparent product at block 206.

In embodiments 100 and 200, respective grinding steps 101 and 204 may be performed through the use of a ball mill such as for example a Retsch planetary ball mill, operated at for example, about 250 rpm for about 24 hours. For the formation of discs, a hydraulic press may be used to compact and compress a circular metal die filled with the powdered date material formed by the ball mill.

For methods 100 and 200, an example delignification solution for respective steps 103 and 202 includes a solution of water, sodium hydroxide (NaOH), and sodium sulfite ($Na_2SO_3$). An example 1 liter solution may include water, about 100 grams of NaOH (or about 10% w/v), and about 50 grams of $Na_2SO_3$ (or about 5% w/v). Delignification steps 103 and 202 may be performed by immersing the formed discs/slices of date palm seeds in the boiling delignification solution overnight for a time period of about 12 hours, to allow full removal of the lignin material which results in better clarity/transparency in the final glass-like sheet. It should be understood, that the time periods and delignification solution are exemplary only, and other time periods and delignification solutions may be used for the effective removal of the lignin. A primary difference between methods 100 and 200 includes the different shapes of the date palm seeds during the delignification steps. In method 100, the delignification steps is performed on a formed disc of the crushed date palm seeds, after the steps of using a ball mill and hydraulic press. Whereas, in method 200, the delignification step is performed on sliced date palm seeds, which have not been passed through a ball mill or hydraulic press. Methods 100 and 200 allow for different shapes of the date palm seeds to be placed in the delignification solution. The sliced date palms seeds at block 201 of method 200 may be sliced by any suitable means, including manually or automatic cutting means.

For the respective bleaching steps 104 and 203 of methods 100, 200, an example bleaching solution includes hydrogen peroxide ($H_2O_2$). An example application of the bleaching solution includes immersing formed discs (method 100) or slices (method 200) in about 2.5 mol/L of hydrogen peroxide for about 2 hours or until a change in color is observed from opaque to transparent or translucent. As with the delignification solution, it is understood that other bleaching solutions and soaking periods may be used in addition to the example of hydrogen peroxide.

For the finalization of the finished transparent sheets in blocks 105, 206, an epoxy resin is applied to the bleached discs. In a non-limiting example, a period of about 12 hours allows for solidification and hardening of the epoxy, and may include a resin and a non-blushing hardener in a ratio of about 2:1.

It is to be understood that the method of forming glass-like sheets is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

The invention claimed is:

1. A method of forming transparent sheets using date palm seeds, the method comprising:

milling date palm seeds to form a powder;

compressing the powder to form discs;

immersing the discs in a delignification solution followed by removal from the delignification solution and washing to form delignified discs;

immersing the delignified discs in a bleaching solution until a change in color of the discs from opaque to transparent or translucent is observed to form bleached discs; and applying an epoxy resin to the bleached discs.

2. The method of forming transparent sheets using date palm seeds as recited in claim 1, wherein the discs are immersed in the delignification solution for about 12 hours.

3. The method of forming transparent sheets using date palm seeds as recited in claim 2, wherein the delignification solution comprises water, sodium hydroxide (NaOH), and sodium sulfite (Na2SO3).

4. The method of forming transparent sheets using date palm seeds as recited in claim 1, wherein a ball mill is used to mill the date palm seeds into the powder.

5. The method of forming transparent sheets using date palm seeds as recited in claim 1, wherein the bleaching solution comprises hydrogen peroxide (H2O2).

6. The method of forming transparent sheets using date palm seeds as recited in claim 1, wherein the epoxy resin comprises resin and a non-blushing hardener in a weight ratio of about 2:1.

7. A method of transforming date seeds into transparent sheets, comprising the steps of:

grinding date seeds in a ball mill to form a powder;

forming discs from the powder using a hydraulic press;

immersing the discs in a boiling delignification solution of water, sodium hydroxide and sodium sulfite for at least 12 hours followed by removal from the delignification solution and washing to form delignified discs;

immersing the delignified discs in a bleaching solution of hydrogen peroxide until a color of the disc changes from opaque to transparent or translucent to form bleached discs; and applying an epoxy resin to the bleached discs for solidification, wherein the epoxy resin includes resin and a non-blushing hardener in a weight ratio of about 2:1.

8. A method of forming transparent sheets using date palm seeds, said method comprising:

cutting date palm seeds to form slices;

immersing the slices in a delignification solution followed by removal from the delignification solution and washing to form delignified slices;

immersing the delignified slices in a bleaching solution until a change in color of the slices from opaque to transparent or translucent is observed to form bleached slices;

grinding the bleached slices in a ball mill to form a powder;

compressing the powder to form discs; and hardening the discs by applying an epoxy resin.

9. The method of forming transparent sheets using date palm seeds as recited in claim 8, wherein the slices are immersed in the delignification solution for about 12 hours.

10. The method of forming transparent sheets using date palm seeds as recited in claim 9, wherein the delignification solution comprises water, sodium hydroxide, and sodium sulfite.

11. The method of forming transparent sheets using date palm seeds as recited in claim 8, wherein the bleaching solution is hydrogen peroxide.

12. The method of forming transparent sheets using date palm seeds as recited in claim 8, wherein the epoxy resin comprises resin and a non-blushing hardener in a weight ratio of about 2:1.

* * * * *